United States Patent [19]

Hanyu et al.

[11] Patent Number: 4,926,770

[45] Date of Patent: May 22, 1990

[54] NEEDLE HOLE GUIDE MECHANISM FOR ZIGZAG SEWING MACHINE

[75] Inventors: Susumu Hanyu; Kazumasa Hara; Yasuro Sano, all of Tokyo, Japan

[73] Assignee: Janome Sewing Machine Company Limited, Tokyo, Japan

[21] Appl. No.: 300,336

[22] Filed: Jan. 23, 1989

[30] Foreign Application Priority Data

Jan. 22, 1988 [JP] Japan ..... 63-10741

[51] Int. Cl.[5] ..... D05B 3/02; D05B 73/12

[52] U.S. Cl. ..... 112/453; 112/184; 112/228; 112/243; 112/260; 112/467

[58] Field of Search ..... 112/243, 228, 260, 184, 112/453, 467

[56] References Cited

U.S. PATENT DOCUMENTS

| | | | |
|---|---|---|---|
| 4,289,084 | 9/1981 | Takenoya et al. | 112/455 |
| 4,303,028 | 12/1981 | Takenoya et al. | 112/453 |
| 4,393,794 | 7/1983 | Eguchi et al. | 112/453 X |
| 4,662,292 | 5/1987 | Koike et al. | 112/467 X |
| 4,693,193 | 9/1987 | Hanyu et al. | 112/467 |

FOREIGN PATENT DOCUMENTS 56-043271 10/1981 Japan .

*Primary Examiner*—Andrew M. Falik

*Attorney, Agent, or Firm*—Frishauf, Holtz, Goodman & Woodward

[57] ABSTRACT

A zigzag sewing machine includes a needle hole member having a round needle hole of a diameter slightly larger than that of a stitching needle. The needle hole member engages a laterally elongated hole in a needle plate and is swingable along the latter. A base member is mounted coaxially with a loop taker and is rotatable relative to the loop taker. The needle hole member is pivoted to the base member for relative vertically swinging movement. A lever swingably mounted on the machine housing engages with the needle hole member, and a cam rotated in synchronism with the vertical reciprocation of the needle is in engagement with the swinging lever. A stepping motor is operatively connected to the needle to reciprocate the needle laterally in the elongated needle plate hole, and the motor is also operatively connected to the base member to reciprocate the base member.

3 Claims, 8 Drawing Sheets

NEEDLE HOLE GUIDE MECHANISM FOR ZIGZAG SEWING MACHINE

BACKGROUND OF THE INVENTION

1. Field of the Invention

The invention relates to a needle receiving hole member guide mechanism for a zigzag sewing machine and more particularly relates to a mechanism for guiding a needle hole member along a laterally elongated hole of a predetermined range formed in a needle plate, in which a vertically reciprocating needle is laterally swung so that zigzag stitches of variable amplitudes may be formed. The mechanism is so structured and operated in synchronism with an upper thread carrying needle to draw out a desired amount of a lower thread required for formation of various types of stitches.

2. Prior Art

As well known in the industrial field, the conventional zigzag sewing machine has a laterally elongated needle hole formed in the needle plate thereof so that a vertically reciprocating and laterally swingable needle may constantly drop one point to form straight stitches and also may be laterally swingable from minimum to maximum to from zigzag stitches of variable amplitudes. However as shown in FIG. 11 depicting the positional relationship between the needle and a fabric or cloth in a conventional zigzag sewing machine, when a needle 17 pierces through the fabric 6 placed on a laterally elongated needle hole 18*a*, the fabric 6 is pushed into the needle hole by the needle 17 and the fabric is slacked down within the needle hole. On the contrary, as shown in FIG. 12, the fabric will be lifted up above the needle plate 18 as needle goes up. Such flapping phenomena of the fabric will fail to make a desired thread loop as the needle goes up as shown in FIG. 14 because there is no sufficient friction between the fabric and the needle. It is apparent that loop taker 28 often fails to catch the thread loop, resulting in skipped stitches.

Consequently, it is therefore desirable to provide a round needle hole of a diameter which is just slightly larger than that of a diameter of the needle 17 as generally known in a straight stitch sewing machine and shown in FIG. 13 and FIG. 14, so as to eliminate the above mentioned defects and disadvantages.

In this respect, published Japanese utility model 56(1981)-43271 discloses a laterally elongated hole 18*a* formed in a needle plate 18 and a member having a round needle hole is in engagement with the hole 18*a* and is reciprocated therein in synchronism with the swinging movement of the needle 17 as shown in FIG. 15.

The present invention has been provided to solve shortcomings of the prior art and to further improve the mechanism of the published Japan Utility Model 56(1981)-43271. In the zigzag sewing machine according to the present invention, the mechanism of the mentioned published Utility Model application has been appropriately modified to draw out a lower thread of an amount required for each of various stitches to be formed.

Originally, a draw-out amount of the lower thread must be suitably changed in consideration of given conditions, such as a thickness of fabric to be sewn, a type of thread to be used, and types of patterns to be stitched by a zigzag sewing machine. In the conventional sewing machine, however, the lower thread is drawn out with a constant amount by a up-and-down movement of a drawing member operated in association with a feed dog which may be adjusted to change the feeding amount of the fabric, that is to change the stitch length.

SUMMARY OF THE INVENTION

The purpose of the present invention is to provide a guiding mechanism for a needle hole member of a zigzag sewing machine having a loop taker of a type to be rotated in a horizontal plane, in which the needle hole member is so placed as to enable to operator to freely access a lower thread carrying bobbin placed in the loop taker. Further means is provided to properly adjust the oscillation center of the needle and that of the needle hole member so that the needle may drop into the needle hole member without fail whenever the needle drops within a predetermined maximum needle swingable range while the needle hole member is vertically oscillated to draw out a required amount of the lower thread corresponding to each of the different needle portion.

In short, the purpose of the present invention resides in a proposal of a novel mechanism for laterally reciprocating the needle hole member in synchronism with the swinging movement of the needle and for vertically oscillating the needle hole member in synchronism with the vertical reciprocation of the needle to draw out a required variable amount of the lower thread in response to various stitching conditions.

The purpose of the present invention is concretely attained by the provision substantially of; a member having formed therein a round needle hole of a diameter a little larger than that of the needle, the needle hole member being in engagement with the laterally elongated hole of the needle plate and swingable along the latter; operation means including a base member mounted coaxially with a loop taker and being rotatable relative to said loop taker, said rotatable base member being pivotally connected to said needle hole member so that said needle hole member may be vertically swingable relative to said rotatable base member; swingable means including a lever swingably mounted on the machine housing and being in engagement with said needle hole member; cam means rotated in synchronism with the vertical reciprocation of said needle and being in engagement with said lever; and actuating means including a stepping motor operatively connected to said needle to laterally reciprocate said needle, said stepping motor being also operatively connected to said rotatable base member to reciprocate the latter.

BRIEF DESCRIPTION OF THE DRAWING

In the Drawing:

FIG. 5*a* is an enlarged sectional view of a shaft phase detection mechanism in FIG. 5;

EMBODIMENTS

Figure 4:
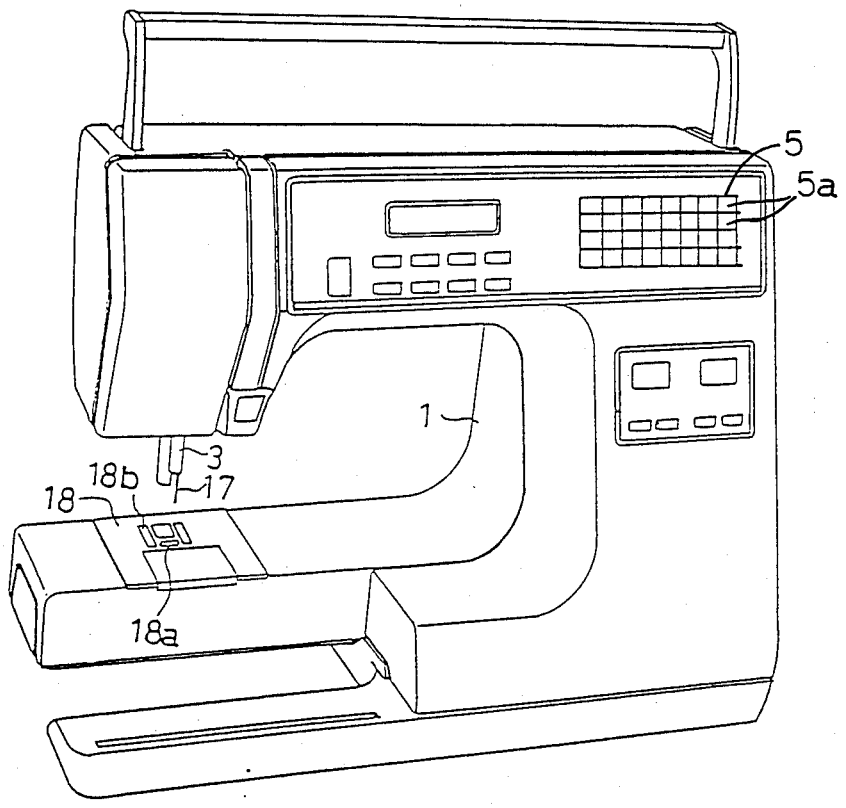
FIG. 4 is an overall view of a sewing machine.
Figure 5:
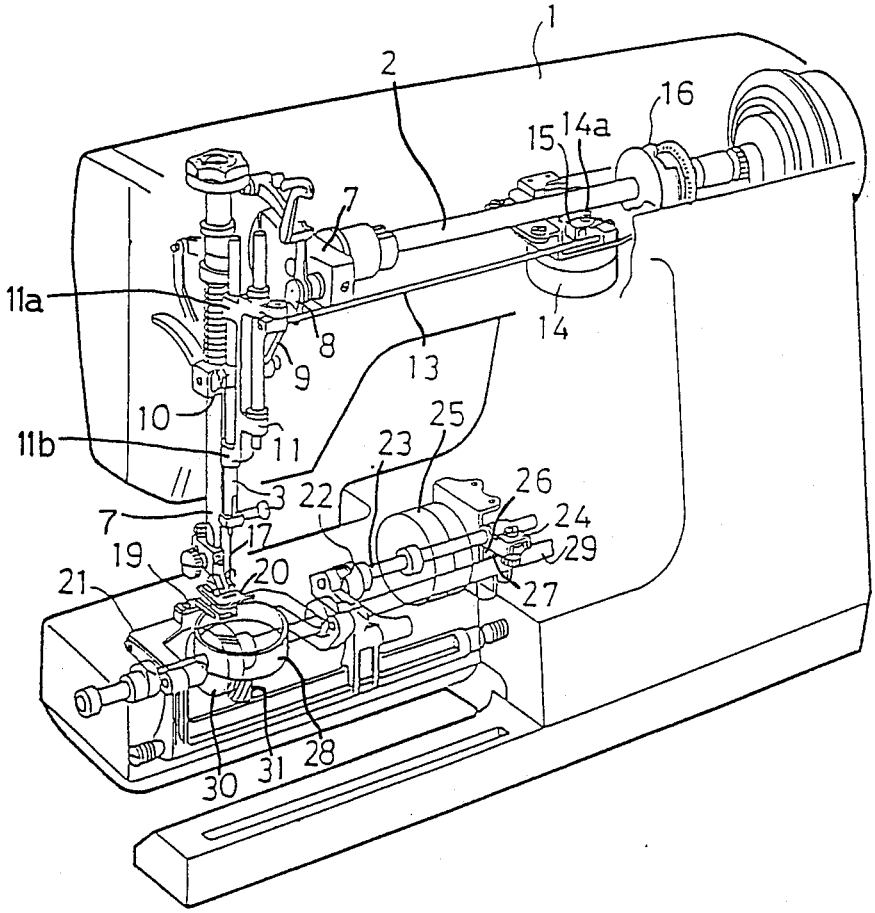
FIG. 5 depicts interior mechanisms of the sewing machine in FIG. 4.

Embodiments of the present invention will be described in detail with reference to the accompanying drawing. As apparent from FIG. 4 depicting the appearance of the zigzag sewing machine, which has a keyboard 5 having a plurality of pattern selection keys 5*a* selectively operated to select a desired pattern from many patterns memorized in a machine frame 1. As shown in FIG. 5, the machine frame 1 has mainly an upper shaft 2 rotated by a drive portion (not shown) and a needle bar 3 connected to the upper shaft 2 so as to move in up-and-down directions. The needle bar 3 is operatively connected to a crank 7 fixed to an end of the upper shaft 2 rotatably supported in the machine frame 1. This bar is fixed to a needle bar holder 10 operatively connected to a crank rod 9. The crank rod 9 is operatively connected to a shaft portion of a needle bar crank 8 fixed to the crank 7. A needle bar support 11 is swingably mounted on a vertical shaft 4 secured to the machine frame 1, and the needle bar 3 is mounted on the needle bar support 11 such that the needle bar is vertically reciprocated relative to the needle bar support 11, as the upper shaft 2 is rotated. A transmission rod 13 has one end connected to the needle bar support 11, and the opposite end connected to an actuating mechanism 15 operatively connected to an output shaft 14*a* of a stepping motor 14 for oscillating the needle rod bar support 11 and the needle bar 3 accordingly. It is noted that the stepping motor 14 is fixed to the machine frame.

A needle 17 is fixed to a lower end of the needle bar 3 and is vertically moved through a laterally elongated needle hole 18*a* formed in the needle plate 18 secured to the machine frame 1.

A feed dog 19 is fixed to a horizontal feeding arm 21 driven by the upper shaft 2. A motion amount of the horizontal feeding arm 21 is adjusted by adjusting an oscillating angle of the feeding arm 21. The feed dog 19 is moved up and down through slots 18*b* formed in the needle plate 18 while the feed dog is moved along a trapezoidal locus as generally known, to thereby cooperate with a presser foot 20 secured to the lower end of a presser bar 7 to transport a fabric relative to the needle 17. The motion amount of the feeding arm 21 is adjusted by a rotary motion of the oscillating angle control member 22 fixed to an end of a control shaft 23. It is understood that an arm 24 fixed to another end of the control shaft 23 is connected to a crank 26 fixed to the output shaft 14*a* of the stepping motor 25 through a link 27.

A loop taker 28 acts as a thread catching means and is rotatably held on the machine frame 1 at a place under the needle plate 18. A gear 30 is fixed to a lower shaft 29 rotatably driven by the upper shaft 2 in synchronization with that of the needle bar 3. The gear 30 is in mesh with a gear 31 integrally fixed to the lower portion of the loop taker 28.

As shown in FIG. 5*a*, a detector 16 for detecting the angular positions of the upper shaft 2 is constructed with a set of disks 61 fixed to the upper shaft and a photo-coupler 62 fixed to the machine frame 1 as generally known.

Both stepping motors 14 and 25 for oscillating the needle rod 3 and for controlling the fabric feeding are driven by pattern information memorized in a memory (not shown) which are read out by means of detecting signals from the rotary phase detector 16.

A lower thread control mechanism of the embodiment of the present invention will be explained below.

Figure 6:
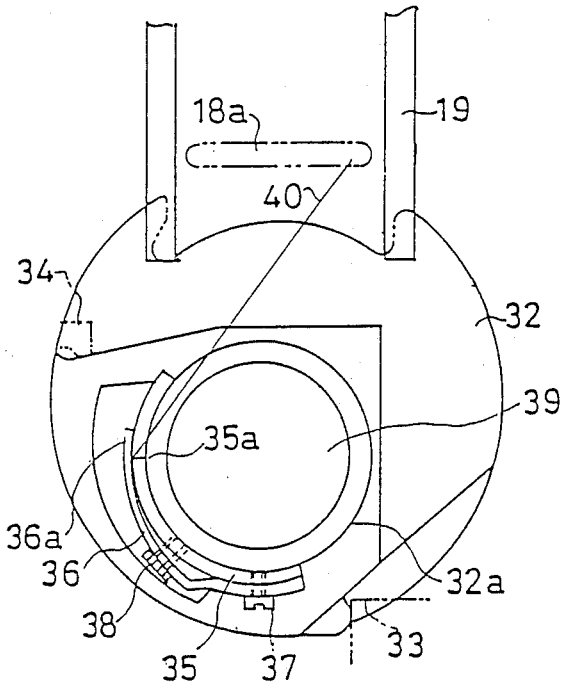
FIG. 6 is an enlarged plan view of an under thread holding device in FIG. 5.

As shown in FIG. 6, a bobbin carrier 32 is rotatably held within the loop taker 28. The bobbin carrier 32 engages with stopper 33 and 34 fixed to the machine frame 1, so that the bobbin carrier 32 is prevented from rotation.

A base plate 35 is fixed on an outer periphery of a bobbin containing chamber 32*a* formed in the bobbin carrier 32 and has a slit-like outlet 35*a* through which the lower thread is drawn out. A lower thread tension spring 36 has one end fixed to the base plate 35 by a screw 37.

The lower thread tension spring 36 has one end secured to the base plate 35 by the screw 37 and a free end 36*a* elastically pressed against the slit-like outlet 35*a*. The spring 36 has a mid opening through which a headed screw 38 passes and is threaded into the base plate 35 in order to adjust a pressing force of the free end 36*a* against the slit-like outlet 35*a* by suitably tightening or loosening the headed screw 38. A bobbin 39 on which a lower thread 40 is wound is installed in the bobbin containing chamber 32*a* of the bobbin carrier 32.

Figure 1:
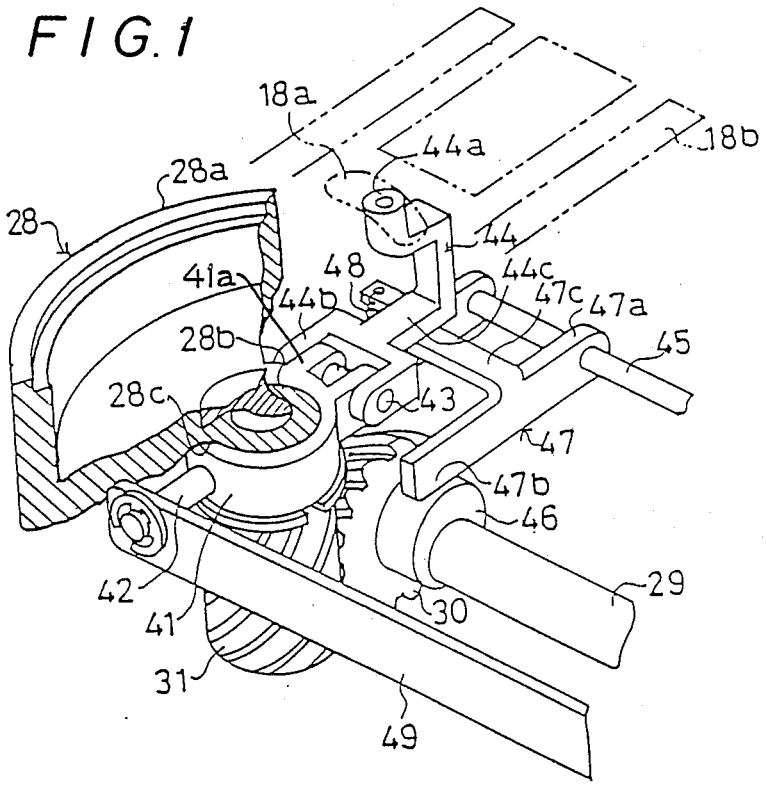
FIG. 1 is a perspective view, with parts broken away, of a needle hole member guiding mechanism.

As shown in FIG. 1, the loop taker 28 is cup-shaped and has a shaft portion 28*b* and portion 28*a*, and receives therein the bobbin carrier 32. A ring-shaped base member 41 is rotatably fitted on the shaft portion 28*b* between a bottom 28*c* of the loop taker 28 and the gear secured to the shaft portion 28*b*.

A lateral pin 42 is secured to the base member 41 and extends perpendicular to the shaft portion 28*b* and parallel to the needle plate 18. The base member 41 has a fork 41*a* formed on the side thereof opposite to the pin 42.

A needle hole member 44 has an upper end portion 44*a* adapted to fit into the laterally elongated needle hole 18*a* of the needle plate 18 so as to move along the needle hole 18*a*. The upper end portion 44*a* has a round needle hole formed therein through which the lower thread is passed up to the needle plate 18. The needle hole member 44 has a lower end formed with a fork 44*b* pivotally connected to the fork 41*a* of the base member 41 by a pin 43 extending perpendicular to the pin 42 and parallel with the needle plate 18. A supporting shaft 45 is fixed to the sewing machine frame 1 in parallel with the lower shaft 29. A thread drawing out lever 47 has one end 47*a* swingably mounted on the supporting shaft 45 and has the opposite end as a follower portion 47*b* placed in engagement with a cam 46 secured to the lower shaft 29. The lever 47 further has an arm 47*c* formed at the intermediate part thereof and extending in parallel with the supporting shaft 45.

The hole member 44 has an extension 44*c* formed between the upper needle hole portion 44*a* and the extension fork portion 44b. The extension 44c extends perpendicular to the upper needle hole portion 44a and in parallel with the lower fork 44b and is placed in engagement with the arm 47c of the lever 47 by means of a spring 48 provided between a part of the needle hole member 44 and the machine frame 1, thus the follower portion 47b is also pressed against the cam 46.

Figure 2:
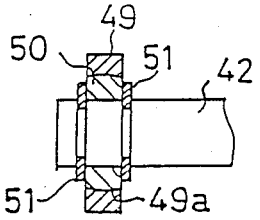
FIG. 2 is an enlarged view of details of a connection between a lever to a base member in FIG. 1.
Figure 3:
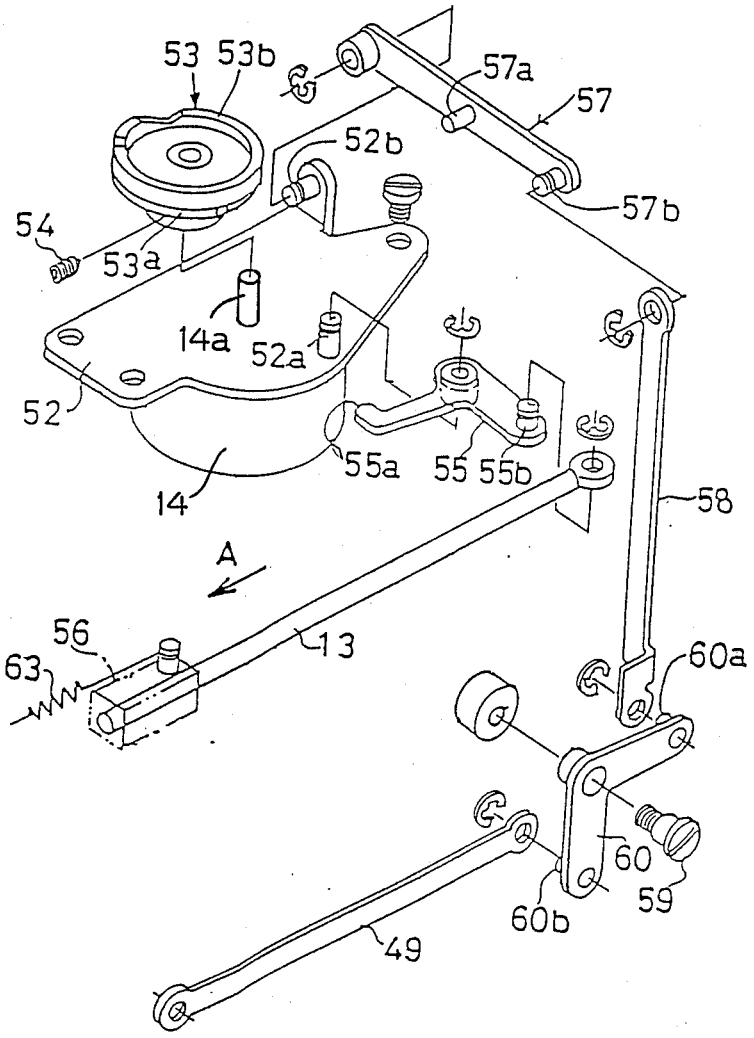
FIG. 3 is an exploded view of an operating mechanism for a needle rod and a needle hole member.

In reference to FIGS. 2 and 3, a transmission bar 49 has one end formed with an opening 49a in which a ball bearing 50 is fitted. The pin 42 of the base member 41 passes through the ball bearing 50. A pair of E-rings 51 are fixed to the pin 42 on both sides of the ball bearing 50.

The actuating mechanism 15 is as shown in FIG. 5, and includes a mount plate 52 secured to the machine frame 1 (see FIG. 3) and has the stepping motor 14 secured thereto. A composite cam 53 is secured to the output shaft 14a of the stepping motor 14 by a screw 54. A lever 55 is turnably mounted on a pin 52a supported on the mount plate 52, and has a follower 55a and a stud 55b as shown. The follower 55a cooperates with a cam portion 53a of the composite cam 53 and the stud 55b is connected to one end of the transmission rod 13. A connecting member 56 is secured to the other end of the rod 13. The connecting rod 13 is always pulled in the direction of arrow A by means of a spring 63 having one end tied to the connecting member 56 and having the other end anchored to the machine frame 1, so that the follower 55a of the lever 55 is turned clockwise to be pressed against the cam portion 53a.

The mount plate 52 has an ear portion 52c. A stud 52b is supported on the ear portion. An arm 57 has one end pivotally connected to the stud 52b and has a pin 57a supported at an intermediate portion thereof. The pin 57a is formed to engage another cam portion 53b of the composite cam 53. Further, the arm 57 has a stud 57b supported on the opposite end thereof. A connecting rod 58 has an upper end pivotally connected to the stud 57b and has a lower end pivotally connected to a stud 60a supported on one end of a lever 60 which is swingably mounted to the machine frame 1 by a stepped screw 59.

The lever 60 has a stud 60b supported on the other end thereof, which is pivotally connected to the end of the transmission rod 49.

OPERATION

The operation of the needle hold guiding mechanism of the zigzag sewing machine according to the present invention will be explained.

The pattern selection keys 5a are optionally operated to select a particular pattern of zigzag stitches and a sewing machine motor (not shown) is driven to rotate the upper shaft 2. The detector 16 is rotated with the upper shaft 2 to detect the rotation phases of the upper shaft. Detection signals are thereby generated for reading out the selected pattern data from the memory to drive the stepping motor 14 for oscillating the needle bar 3 and the needle 17, and another stepping motor 25 for moving the feed dog 19. The former stepping motor 14 is driven when the needle 17 is above the needle plate 18. Namely, the lever 55 engaging the cam portion 53a of the composite cam 53 secured to the output shaft 14a of the stepping motor 14 is rocked around the stud 52a to laterally reciprocate the transmission rod 13. As a result, the needle bar support 11 is oscillated around the vertical shaft 4 thus to oscillate the needle bar 3 and the needle 17.

Further, the arm 57 having the follower pin 57a in engagement with the cam portion 53b of the composite cam 53 is rocked around the stud 52b to oscillate the lever 60 around the stepped screw 59 by way of the transmission rod 58. The transmission rod 49 is therefore laterally reciprocated to oscillate the base member 41 around the loop taker shaft 28b. Therefore, the needle hole portion 44a of the needle hole member 44 is laterally reciprocated within the laterally elongated needle hole 18a of the needle plate 18 in synchronism with the needle 17.

Further, as the lower shaft 29 is rotated in synchronism with the upper shaft 2, the thread drawing out lever 47 is rocked around the support shaft 45 due to rotation of the cam 46 and action of the spring 48. Namely, the lever 47 is rocked up-and-down in synchronization with the vertical and lateral motion of the needle 17. More precisely, the cam 46 is so formed as to rock the needle hole member per stitch, that is, each time the needle position is changed.

Figure 7:
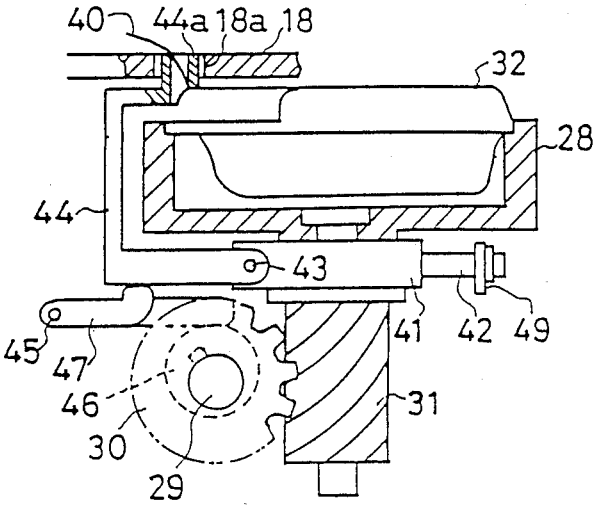
FIGS. 7 and 8 are elevational views, partly in section, showing two under thread drawing-out conditions.
Figure 8:
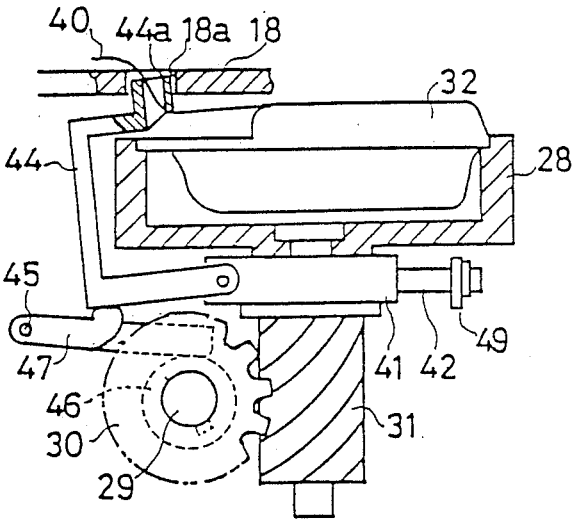

It is understood that the needle hole portion 44a of the needle hole member 44 and the needle 17 always occupy the same position and the needle hole portion 44a is moved up-and-down to pull out the lower thread from the bobbin 39 in the bobbin carrier 32, the lower thread 40 extending through the needle hole portion 44a up to the fabric beneath the needle plate as shown in FIGS. 7 and 8.

According to the first embodiment of the present invention, as described above, the needle hole member 44 is driven by the stepping motor 14 for oscillating the needle rod and also for driving the needle rod, however it may be driven by any known mechanical means.

The second embodiment of the guiding mechanism for a needle hole member according to the present invention will be explained with reference to FIGS. 9 and 10.

It is noted that a pin 163 is formed on the lower shaft 29. The drawing out cam 146 is rotatably fitted on the lower shaft 29 as shown in the drawing so as to form an eccentric cam on the shaft 29. The value of eccentricity on the drawing out cam 146 is small at a side of the lower shaft gear 30 and large at another side of the flywheel. The cam 146 has an inner longitudinal key groove 146d to which groove the pin 163 fits, so that the cam 146 moves only along the longitudinal direction of the lower shaft 29 and is driven to rotate.

Figure 9:
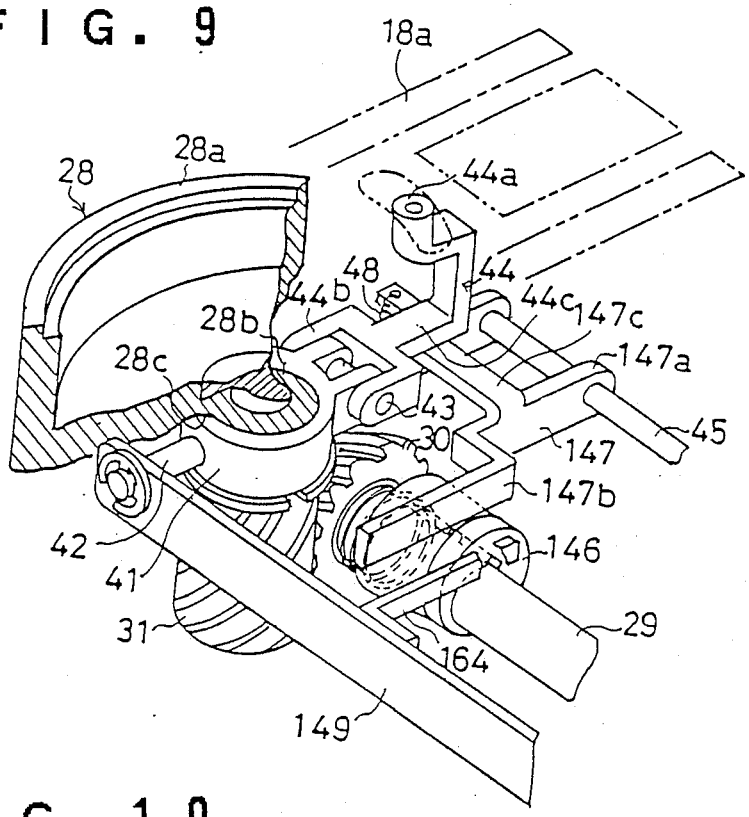
FIG. 9 is a perspective view, with parts broken away, of a needle hole member guiding mechanism according to a second embodiment.

As shown in FIG. 9, a function bar 164 is secured to the lever 149 so as to confront to an end face of a boss 146e of the drawing out cam 146. A function spring 150 is placed around the lower shaft 29, and between the lower shaft gear 30 and the drawing out cam 146 so as to press the cam 146 along the direction of arrow B. Thus, an end face of the boss 146e and the function plate 164 are always applied to each other and situated in place.

The operation of the second embodiment above will be described. As that of the first embodiment of the present invention, the pattern selection keys 5a are operated to select the pattern to be sewn, issuing start command for stitching. Consequently, the machine's motor is driven to rotate the upper shaft 2, and the stepping motor 14 for oscillating the needle rod, and stepping motor 25 for controlling the feed are driven in synchronization of the up-and-down motion of the needle rod 3, carrying out pattern stitchings.

A rotation of the stepping motor 14 for oscillating the needle rod drives the lever 149 along the left-and-right direction or the axial direction of the lower shaft 29 in a manner similar to that of the first embodiment of the present invention described above. Accordingly, the base member 41 rotates around the shaft portion **28*b* and the needle hole member 44 functionally connected to the base member 41 is driven. The needle hole portion 44*a* at the front end of the needle hole member is always driven to the same position as that of the descending needle driven by an oscillation movement of the needle rod 3. Left-and-right movement of the lever 149 and the function bar 164 integrally formed thereon moves the drawing out cam 146 along the lower shaft 29**.

When the needle rod 3 is driven to the furthest left position within the oscillation range by the rotating combined cam 53 fixed to the output shaft **14*a* of the stepping motor 14 for oscillating the needle rod, the lever 149 is moved along the direction of arrow B and the base member 41 is rotated counterclockwise, so that the needle hole portion 44*a* at the front end of the needle hole member 44 is moved to the position corresponding to the furthest left position of the needle rod 3**.

It is noted that when the motion of the function bar 164 fixed to the lever 149 along the direction of arrow B takes place, the drawing out cam 146 moves on the lower shaft 29 along the direction of arrow B by means of the action of the function spring 150. The drawing out cam 146 has a lower phase portion **146*a* having a thickness or distance (a) from an axis line of the lower shaft 29 and an upper phase portion 146*b* having a thickness or distance (b) measuring from the axis line. Because the difference between these distances has been set to be small as shown in FIG. 10, it is small in angular or rotation value of the drawing out lever 47 which is rotated when the lower shaft 29 with the drawing out cam 146 rotates. Consequently, the needle hole portion 44*a* at the front end of the needle hole member 44** draws out a small length of the under thread.

When the needle rod 3 is at the furthest right position of the oscillation range, the lever 149 is moved along an opposite direction from the arrow B so as to rotate the base member 41 counterclockwise, so that the needle hole portion **44*a* at the front end of the needle hole member 44 takes its furtheset right position of the oscillation range corresponding to the position of the needle rod 3**.

Figure 10:
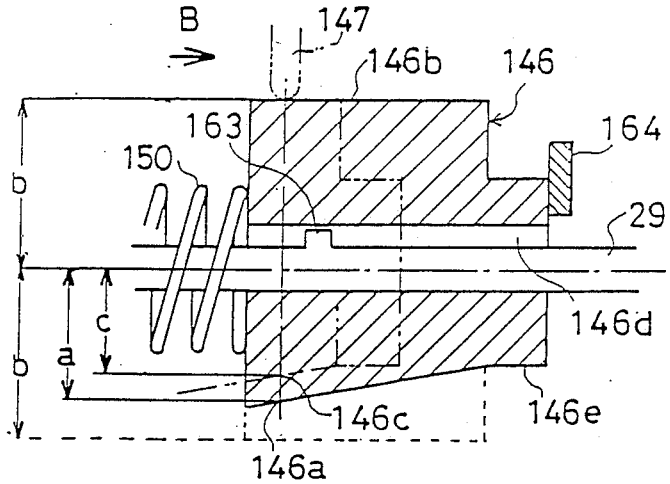
FIG. 10 is an enlarged sectional view of a cam for drawing-out under thread in the mechanism of FIG. 9.
Figure 11:
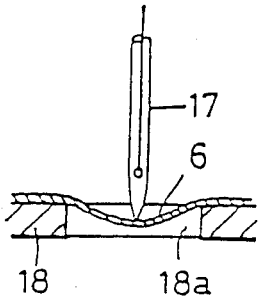
FIG.11 PRIOR ART
FIGS. 11 and 12 are elevational views depicting a relation of a needle and a cloth at a needle hole in a conventional zigzag sewing machine.
Figure 13:
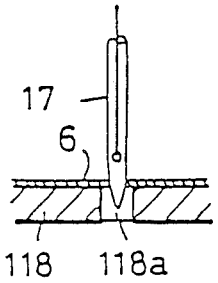
FIG.13 PRIOR ART
FIGS. 13 and 14 are elevational views depicting conditions of a needle and cloth in a straight stitch sewing machine.
Figure 12:
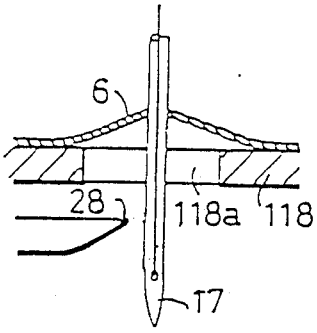
FIG.12 PRIOR ART
Figure 14:
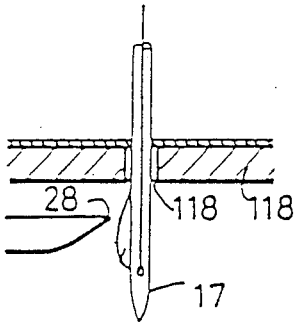
FIG.14 PRIOR ART
Figure 15:
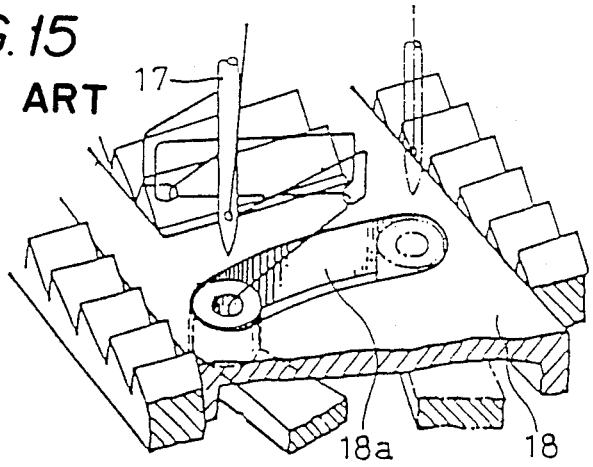
FIG.15 PRIOR ART
FIG. 15 is a perspective view of part of a core type needle hole defining mechanism operating in synchronism with the position of a reciprocating needle.

It is apparent that the difference between distance (a) and another distance (c) of the drawing out cam 146, which are measured at the position of the surface of the cam 146 on which the lever portion **147*b* contacts, has been set to be large as shown in FIG. 10. When the function bar 164 fixed to the lever 149 moves along the opposite direction from the arrow B as described above and the lower shaft 129 rotates, the rotation value of the drawing out lever 47 is made large, resulting in a relatively long length of the under thread to be drawn through the needle hole portion 44*a***.

The profile of the drawing out cam 146 consisting of respective portions of these distance (a), (b) and (c) is constructed so as to be smoothly and linearly changed, so that it is possible to set the drawing out volume or length of the under thread corresponding to the particular position of the needle hole member 44 within its oscillation range. It is noted that the drawing out length is set to the smallest one when the needle rod is placed at the furthest left position in its oscillation range and it is set to the largest one when the needle rod is at its furthest right position. In the transient positions of the oscillation range, the length of the under thread to be drawn out is changed so as to correspond with the particular positions of the needle rod in the oscillation range. It is possible to revise or amend any deviation or deflection, if any, of the under thread when a zigzag sewing is carried out by changing the drawing out volume of the under thread.

Consequently, it is possible according to the present invention always to provide a small needle hole, so that cloth does not invade or get pulled into the needle hole during a stitching operation.

What is claimed is:

1. A zigzag sewing machine having stitch forming instrumentalities including a vertically reciprocating and laterally swingable needle having an upper thread carried thereon, and a loop taker having a lower thread loaded bobbin carried therein and rotatable in a horizontal plane in synchronism with the needle to catch the upper thread and interconnect the upper thread with the lower thread and form lock stitches, the needle being vertically reciprocated by an upper drive shaft rotatably journalled on a machine housing while the loop taker is rotated by a lower shaft operatively connected to the upper drive shaft for rotation therewith, a needle plate having a laterally elongated hole formed therein for receiving the laterally swingable needle, said sewing machine comprising:

(a) needle hole means including a member having formed therein a round needle hole of a diameter slightly larger than that of the needle, the needle hole member being in engagement with the laterally elongated hole of the needle plate and swingable along the latter;

(b) operation means including a base member mounted coaxially with said loop taker and being turnable relative to said loop taker;

(c) means for pivotally connecting said needle hole member to said base member so that said needle hole member may be vertically swingable relative to said base member;

(d) swingable means operatively connected to said needle hole member;

(e) first actuating means including a cam rotated in synchronism with the vertical reciprocation of said needle to swing said swingable means; and (f) second actuating means including a stepping motor operatively connected to said needle to laterally reciprocate said needle, said stepping motor being also operatively connected to said base member to reciprocate the latter.

2. The sewing machine as defined in claim 1, wherein said cam includes an eccentric cam secured to said lower shaft for rotation therewith.

3. The sewing machine as defined in claim 1, wherein said cam includes an eccentric cam axially tapered and mounted on said lower shaft for rotation therewith and also being slidable axially of said lower shaft and operatively connected to said second actuating means.

* * * * *